US008138743B2

(12) United States Patent
Ide

(10) Patent No.: US 8,138,743 B2
(45) Date of Patent: Mar. 20, 2012

(54) BAND-GAP REFERENCE VOLTAGE SOURCE CIRCUIT WITH SWITCHABLE BIAS VOLTAGE

(75) Inventor: Akira Ide, Tokyo (JP)

(73) Assignee: Elpida Memory, Inc., Tokyo (JP)

( * ) Notice: Subject to any disclaimer, the term of this patent is extended or adjusted under 35 U.S.C. 154(b) by 537 days.

(21) Appl. No.: 12/357,992

(22) Filed: Jan. 22, 2009

(65) Prior Publication Data

US 2009/0189590 A1 Jul. 30, 2009

(30) Foreign Application Priority Data

Jan. 25, 2008 (JP) ..... 2008-014961

(51) Int. Cl.
*G05F 3/16* (2006.01)

(52) U.S. Cl. ..... 323/313; 323/315; 323/316

(58) Field of Classification Search ..... 323/313, 323/315, 901, 316
See application file for complete search history.

(56) References Cited

U.S. PATENT DOCUMENTS

| | | | | |
|---|---|---|---|---|
| 5,077,518 | A * | 12/1991 | Han | 323/275 |
| 5,260,646 | A * | 11/1993 | Ong | 323/349 |
| 6,018,235 | A | 1/2000 | Mikumi | |
| 7,385,378 | B2 * | 6/2008 | Itoh | 323/280 |
| 2007/0210856 | A1 | 9/2007 | Uehara | |

FOREIGN PATENT DOCUMENTS

| | | |
|---|---|---|
| JP | 10-143265 | 5/1998 |
| JP | 10-232724 | 9/1998 |
| JP | 2007-249948 | 9/2007 |

* cited by examiner

*Primary Examiner* — Jeffrey Sterrett
*Assistant Examiner* — Lakaisha Jackson
(74) *Attorney, Agent, or Firm* — Foley & Lardner LLP

(57) ABSTRACT

A band-gap reference voltage source circuit is constituted of a diode-pair circuit connected to a reference voltage output terminal, a first differential amplifier including a first transistor and a first operational amplifier, and a second differential amplifier including a second transistor and a second operational amplifier. The second differential amplifier operates based on a bias voltage, which is lower than a predetermined voltage, so as to forcedly pull up the level of the reference voltage output terminal via the second transistor before the first differential amplifier starts to pull up the level of the reference voltage output terminal up to the predetermined voltage via the first transistor.

20 Claims, 10 Drawing Sheets

Prior Art

Prior Art

Prior Art

BAND-GAP REFERENCE VOLTAGE SOURCE CIRCUIT WITH SWITCHABLE BIAS VOLTAGE

BACKGROUND OF THE INVENTION

1. Field of the Invention

The present invention relates to band-gap reference voltage source circuits which serve as reference voltage sources in semiconductor integrated circuits.

The present application claims priority on Japanese Patent Application No. 2008-14961, the content of which is incorporated herein by reference.

2. Description of Related Art

Various technologies regarding band-gap reference voltage source circuits have been developed and disclosed in various documents such as Patent Documents 1 to 3.

Patent Document 1: Japanese Unexamined Patent Application Publication No. H10-232724

Patent Document 2: Japanese Unexamined Patent Application Publication No. H10-143265

Patent Document 3: Japanese Unexamined Patent Application Publication No. 2007-249948

The constitution and operation of a band-gap reference voltage source circuit will be described with reference to FIGS. 5 to 11.

The band-gap reference voltage source circuit of FIG. 5 is constituted of a differential amplifier AMP 1 and a diode-pair circuit BRG_Diode_Pair, which are illustrated as blocks defined by dotted lines. In the diode-pair circuit BRG_Diode_Pair, load resistors R1 and R2 are connected to diodes D1 and D2 having different junction areas, wherein a resistor R3 is further connected to the diode D2 having a larger junction area. A node IN1 formed between the diode D1 and the resistor R1 serves as one input terminal of the differential amplifier AMP1, while a node IN2 formed between the resistors R2 and R3 serves as another input terminal of the differential amplifier AMP1. The output terminal of the differential amplifier AMP1 is connected to an output terminal BG_REF which is also connected with the resistors R1 and R2. When the differential amplifier AMP1 has an adequately high amplification factor of voltage, the differential amplifier AMP1 operates to make a differential voltage ΔVIN=V_VIN2−V_IN1 become zero, wherein V_IN1 designates a potential at the node IN1, and V_IN2 designates a potential at the node IN2. Currents I1 and I2 flowing through the diodes D1 and D2 are expressed by equations (1) and (2).

$$I1 = \frac{\text{V_BG_REF} - \text{V_IN1}}{R1} \tag{1}$$

$$I2 = \frac{\text{V_BG_REF} - \text{V_IN2}}{R2} \tag{2}$$

In equations (1) and (2), V_BG_REF designates a reference voltage at the reference voltage output terminal BG_REF, and R1 and R2 designates the resistances of the resistors R1 and R2. For the sake of convenience, the following description is made based on the presumption of R1=R2. In this case, the same potential is set to the nodes IN1 and IN2, hence, I1=I2.

The differential amplifier AMP1 is constituted of P-channel MOS (Metal Oxide Semiconductor) transistors MP1, MP3, and MP4 whose sources are connected to a drive voltage (electronic power-supply voltage) VDD, an N-channel MOS transistor MN3 whose source is connected to a ground potential VSS, an N-channel MOS transistor MN1 whose drain is connected to the drain of the transistor MP3 and whose source is connected to the drain of the transistor MN3, an N-channel MOS transistor MN2 whose drain is connected to the drain of the transistor MP4 and whose source is connected to the drain of the transistor MN3, and a phase compensation capacitor C1. The gates of the transistors MP3 and MP4 are connected together and are also connected to the drain of the transistor MP4. The gate of the transistor MP1 is connected to the drain of the transistor MP3, and the capacitor C1 is connected between the gate and source of the transistor MP1. The gate of the transistor MN3 receives an output voltage V_BIAS_N of a bias generator which is configured of a current mirror circuit (not shown), thus controlling the drain current (or tail current) $I_0$ at a constant value.

In the differential amplifier AMP1, the N-channel MOS transistors MN1, MN2, and MN3, and the P-channel transistors MP3 and MP4 form a differential amplification block whose input terminals correspond to the gates of the transistors MN1 and MN2 and whose output terminal corresponds to the drain of the transistor MP1.

When the junction area of the diode D1 is N times (where N>1) larger than the junction area of the diode D1, the relationships defined by equations (3) and (4) are established between forward voltages VD1 and VD2 of the diodes D1 and D2.

$$I1 = J0 \cdot A1 \cdot \exp\left[\frac{VD1}{(kT/q)}\right] \tag{3}$$

$$I2 = J0 \cdot A2 \cdot \left[\frac{VD2}{(kT/q)}\right] \tag{4}$$

In equations (3) and (4), J0 designates a reverse saturation current per unit area; A1 and A2 designate the junction areas of the diodes D1 and D2; k designates a Boltzmann constant; and q designates an electron charge.

The following equations (5) and (6) are produced based on equations (3) and (4).

$$\frac{I1}{I2} = \left(\frac{A1}{A2}\right) \cdot \exp\left[\frac{\Delta VD}{(kT/q)}\right] = 1 \tag{5}$$

$$\Delta VD = VD1 - VD2 = \left(\frac{kT}{q}\right) \cdot \ln\left(\frac{A2}{A1}\right) = \left(\frac{kT}{q}\right) \cdot \ln(N) \tag{6}$$

Equation (7) is produced based on equations (5) and (6) in which ΔVD designates a voltage applied to the resistor R3.

$$I1 = I2 = \left(\frac{kT}{q}\right) \cdot \frac{\ln(N)}{R3} \tag{7}$$

In equation (7), R3 designates the resistance of the resistor R3. Based on the above equations, the reference voltage V_BG_REF is expressed by equation (8).

$$\text{V_BG_REF} = VD1 + \left(\frac{R1}{R3}\right) \cdot \left(\frac{kT}{q}\right) \cdot \ln(N) \tag{8}$$

In equation (8), the first term "VD1" has a negative coefficient of temperature dependency, while the second term has a positive coefficient of temperature dependency. By performing differentiation with respect to temperature T (which is then set to zero), it is possible to calculate the condition for canceling the temperature dependency, details of which are omitted, but which is canceled when the output voltage is approximately set to a band-gap Eg (ranging from 1.1 V to 1.2 V).

Based on the presumption where V_BG_REF=1.2 V, VD1=0.6 V, N=8, T=300 K, and R1=R2, equation (8) is developed into equation (9).

$$1.2\,\mathrm{V} = 0.6\,\mathrm{V} + \left(\frac{R1}{R3}\right)\cdot 0.0538\,\mathrm{V} \tag{9}$$

Thus, R1/R3=11.15 is calculated. At this time, the band-gap reference voltage source circuit of FIG. 5 is designed in the condition of I1=1 μA, thus producing equation (10).

$$R3 = \frac{0.0538\,\mathrm{V}}{1\,\mu\mathrm{A}} = 53.8\ \mathrm{k\Omega} \tag{10}$$

$$R1 = 11.15R3 = 600\ \mathrm{k\Omega}$$

The above calculations are created based on the steady-state condition of the band-gap reference voltage source circuit in which the operation is started normally. In the electronic power-supply activation (power-on event), the differential amplifier AMP1 is set to a transient state in which the same potential is not necessarily set to the nodes IN1 and IN2. The following examination will be given with respect to the state of the diode-pair block BGR_Diode_Pair in the band-gap reference voltage source circuit whose reference voltage V_BG_REF is not set to a desired level.

The reference voltage V_BG_REF is given in conjunction with an arbitrary value of the current I1 by equation (11)

$$V_BG_\mathrm{REF} = VD1 + R1\cdot I1 \tag{11}$$

Since the slope of logarithmic current-voltage characteristics of a diode is calculated as (kT/q)ln10=60 mV/decade using T=300K, the forward voltage VD1 of the diode D1 can be expressed by equation (12).

$$VD1 = 0.6\,\mathrm{V} + 0.06\,\mathrm{V}\cdot\log\left(\frac{I1}{1\,\mu\mathrm{A}}\right) \tag{12}$$

Thus, equation (11) is developed into equation (13).

$$\mathrm{V_BG_REF} = 0.6\,\mathrm{V} + 0.06\,\mathrm{V}\cdot\log\left(\frac{I1}{1\,\mu\mathrm{A}}\right) + R1\cdot I1 \tag{13}$$

Similarly, the reference voltage V_BG_REF is given in conjunction with an arbitrary value of the current I2 by equation (14).

$$V_BG_\mathrm{REF} = VD2 + (R2+R3)\cdot I2 \tag{14}$$

Since the junction area of the diode D2 having the voltage VD2 is N (where N=8) times larger than the junction area of the diode D1 having the voltage VD1, the voltage VD1 is expressed by equation (15).

$$VD2 = 0.6V + 0.06V\cdot\log\left(\frac{I2}{N\cdot 1\mu A}\right) \tag{15}$$

Thus, equation (14) is developed into equation (16).

$$\mathrm{V_BG_REF} = 0.6V + 0.06V\cdot\log\left(\frac{I1}{N\cdot 1\mu A}\right) + (R2+R3)\cdot I2 \tag{16}$$

Since both the equations (13) and (16) indicate the same reference voltage V_BG_REF at the reference voltage output terminal BG_REF, it is possible to produce equation (17).

$$0.06V\cdot\log\left(N\cdot\frac{I1}{I2}\right) + R1\cdot I1 - (R2+R3)\cdot I2 = 0 \tag{17}$$

Equation (17) can be further developed into equation (18) by use of the relationship of 0.06V=(kT/q)ln10.

$$\left(\frac{kT}{q}\right)\cdot\ln\left(N\cdot\frac{I1}{I2}\right) + R1\cdot I1 - (R2+R3)\cdot I2 = 0 \tag{18}$$

It is possible to calculate the current I2 based on equations (17) and (18) if the value of the current I1 is given. The results of calculations regarding the currents I1 and I2 and the reference voltage V_BG_REF of the reference voltage output terminal BG_REF are shown in FIGS. 6, 7, and 8.

FIG. 6 shows the relationship between the reference voltage V_BG_REF and the sum of the currents I1 and I2 flowing through the diodes D1 and D2, i.e. I1+I2, in the band-gap reference voltage source circuit. FIG. 6 clearly shows that the currents I1 and I2 may rapidly decrease below V_BG_REF=0.5 V.

FIG. 7 shows the relationship between the reference voltage V_BG_REF and the potentials V_N1 and V_IN2 at the terminals IN1 and IN2 in the band-gap reference voltage source circuit. FIG. 7 clearly shows that the potential difference between the terminals IN1 and IN2 may rapidly decrease below V_BG_REF=0.5 V.

FIG. 8 shows the relationship between the reference voltage V_BG_REF and the differential voltage ΔVIN=V_IN2−V_IN1 (between the terminals IN1 and IN2) in the band-gap reference voltage source circuit. FIG. 8 clearly shows that the differential voltage ΔVIN may rapidly be asymptotic in zero below V_BG_REF=0.5 V.

In the initial stage of the electronic power-supply activation (power-on event) in which the power-supply voltage is so low that no current flows in the diode-pair block BGR_Diode_Pair in the band-gap reference voltage source circuit, and both the potentials V_IN1 and V_IN2 are very low such as approximately 0.4 V. In order to allow the tail current $I_0$ to flow in the differential amplifier AMP1, it is necessary to establish a first condition in which the gate-source voltage of the transistor MN1 is higher than a threshold voltage VT(MN1) of the transistor MN1 and a second condition in which the drain-source voltage VDS(MN3) of the transistor MN3 serving as a constant current source is at least 3 kT/q. That is, the differential amplifier AMP1 does not operate without the relationship of inequality (19).

$$V_IN1 \geq VT(MN1) + \frac{3kT}{q} \tag{19}$$

In the above inequality (19), the voltage VT(MN1) is not strictly the threshold voltage of MN1. Usually, a threshold voltage is defined as a gate-source voltage allowing a predetermined current to flow in a MOS transistor. A typical value of the predetermined current is 0.1 μA per unit gate width, i.e. Ivt=0.1 μA/μm. If the gate width of MN1 is W=10 μm, VT(MN1) causes 1 μA of drain current. However, in actuality, the differential amplifier AMP1 is capable of operating with a lower current than 1 μA. By use of a tail current Ioc (representing the operation limit of the differential amplifier AMP1) and a coefficient S representing the slope of logarithmic characteristics between the drain current and gate voltage in a tailing region, inequality (19) can be developed into inequality (20).

$$V_IN1 \geq VT(MN1) + S \cdot \log\left(\frac{Ioc}{W \cdot Ivt}\right) + \frac{3kT}{q} \tag{20}$$

In numerical conditions where VT(MN1)=0.55 V, S=90 mV/decade, Ioc=10 nA, W=10 μm, Ivt=0.1 μA/μm, and T=300 K, inequality (20) can be developed as V_IN1≧0.55V−0.18V+0.078V=0.448V.

The above numerals and FIGS. 7 and 8 show that inequality (19) is not established when no current flows through the diodes D1 and D2 of the diode-pair block BGR_Diode_Pair in the initial stage of electronic power-supply activation (power-on event) of the band-gap reference voltage source circuit, wherein the tail current $I_0$ does not flow in the differential amplifier AMP1, which does not operate at high probability. In other words, since the input voltages of AMP1, V_IN1 and V_IN2 are very low such as approximately 0.4 V, the differential amplifier AMP1 cannot operate so that the transistor MP1 is still turned off, wherein there is no means for boosting the potentials V_IN1 and V_IN2. That is, the band-gap reference voltage source circuit is in a zero-current state and cannot move into an operation state.

To avoid such a zero-current state in which the band-gap reference voltage source circuit cannot start operation, it is possible to provide a countermeasure in which a current is forced to flow into a desired point of the band-gap reference voltage source circuit during a transient period of boosting the drive voltage (electronic power-supply voltage) VDD which is detected. FIG. 9 shows an example of the countermeasure adapted to the band-gap reference voltage source circuit of FIG. 5.

The circuitry of FIG. 9 includes a detector block VDD_Detector in addition to the circuitry of the band-gap reference voltage source circuit shown in FIG. 5, wherein parts identical to those shown in FIG. 5 are designated by the same reference numerals; hence, duplicate descriptions thereof are simplified or omitted. The detector block VDD_Detector is designed such that the gate of an N-channel MOS transistor MN14 is connected to a node N1 between resistors R9 and R10 which are connected between the drive voltage (electronic power-supply voltage) VDD and the ground potential VSS; a resistor R11 is connected between the drive voltage (electronic power-supply voltage) VDD and a node N2 (corresponding to the drain of the transistor MN14; an inverter whose input terminal corresponds to the node N2 is configured of a P-channel MOS transistor MP12 and an N-channel MOS transistor MN15; an inverter whose input terminal corresponds to a node N3 (which serves as an output terminal of the inverter configured of the transistors MP12 and MN15) is configured of a P-channel MOS transistor MP13 and an N-channel MOS transistor MN16; an inverter whose input terminal corresponds to a node N4 (which servers as an output terminal of the inverter configured of the transistors MP13 and MN16) is configured of a P-channel MOS transistor MP14 and an N-channel MOS transistor MN17; and the gate of a P-channel MOS transistor MP15 is connected to a node N5 (which serves as an output terminal of the inverter configured of the transistors MP14 and MN17).

In the detector block VDD_Detector, a fragmental voltage divided by a voltage divider configured of the resistors R9 and R10 is applied to the gate of the transistor MN14. The current flowing through the transistor MN14 increases as the drive voltage (electronic power-supply voltage) VDD increases, whereby when a resistive voltage drop of the resistor R11 becomes sufficiently high, the output signal of the inverter configured of the transistors MP12 and MN15 is inverted from a low level to a high level. Then, the level of the node N5 turns to a high level from a low level as same as the level of the node N3; hence, the gate potential of the transistor MP15 is changed from a low level to a high level. That is, when the drive voltage (electronic power-supply voltage) VDD is relatively low, the transistor MP15 is turned on so as to force a current to flow into the output terminal BG_REF. As the drive voltage (electronic power-supply voltage) VDD becomes higher, the transistor MP15 is turned off so that the circuitry of FIG. 9 operates similar to the band-gap reference voltage source circuit of FIG. 5. The detector block VDD_Detector detects the lowness of the drive voltage (electronic power-supply voltage) VDD so as to turn on the transistor MP15, thus avoiding the zero-current state in which the band-gap reference voltage source circuit cannot start operation.

In the detector block VDD_Detector shown in FIG. 9, a transient voltage Vtrip, which may correspond to a fragmentation of the drive voltage (electronic power-supply voltage) VDD occurring when the state of the transistor MN14 is changed from Off to ON, may presumably depend upon the threshold voltage VT(MN14) of the transistor MN14 when the resistor R11 has a relatively high resistance. By use of a voltage-division ratio α=R10/(R9+R10) of the resistive voltage divider configured of the resistors R9 and R10, the transient voltage Vtrip is given by equation (21).

$$Vtrip = \frac{VT(MN14)}{\alpha} \tag{21}$$

A transient time Tt is calculated by equation (22) using a steady-state voltage VDD0 of the drive voltage (electronic power-supply voltage) VDD, and a rising time Tr which is a transient time from 0V to VDD0 of the drive voltage (electronic power-supply voltage) VDD.

$$Tt = Tr \cdot \frac{VT(MN14)}{\alpha \cdot VDD0} \tag{22}$$

To turn on the pull-up transistor MP15, the drive voltage (electronic power-supply voltage) VDD should be higher than the absolute value of the threshold voltage of the transistor MP15, i.e. |VT(MP15)|. The potential of the output terminal BG_REF is maintained at VDD for a time Th which is given by equation (23).

$$Th = Tr \cdot \frac{\left[\frac{VT(MN14)}{\alpha} - |VT(MP15)|\right]}{VDD0} \tag{23}$$

Equation (23) shows that the time Th for maintaining the potential of the output terminal BG_REF at VDD is proportional to the rise time of the drive voltage (electronic power-supply voltage) VDD. FIG. 10 diagrammatically shows the above relationships, wherein the horizontal axis represents time, and the vertical axis represents voltage of the VDD_Detector output. FIG. 10 shows the time-related variations of the potential of the output terminal BG_REF after "zero" time at which the drive voltage (electronic power-supply voltage) starts rising, wherein dotted lines indicate the level of the drive voltage (electronic power-supply voltage) VDD, and solid lines indicate the potential of the output terminal BG_REF.

When the time Th defined by equation (23) is longer than a start-up time required for the differential amplifier AMP1 to start the operation, it is possible to reliably start the operation of the band-gap reference voltage source circuit. Next, the start-up time of the differential amplifier AMP1 will be examined in detail.

It is presumed that the differential amplifier AMP1 of the band-gap reference voltage source circuit of FIG. 9 starts operation when the transistor MP1 is turned on to allow a current to flow therethrough. Hence, a time which is required to decrease the voltage of the node A1_OUTB by a threshold voltage VT(MP1) of the transistor MP1 from its initial voltage of VDD level is regarded as the minimum (or worst) start-up time of AMP1.

By use of a coefficient S representing the slope of the drain current (in logarithm) and gate-source voltage, a mutual conductance gm applied to a pair of the transistors MN1 and MN2 in the differential amplifier AMP1 is given by equation (24).

$$gm = \frac{(I_0/2)}{(S/\ln 10)} \tag{24}$$

In equation (24), $I_0$ designates a tail current of the differential amplifier AMP1, wherein both the transistors MN1 and MN2 operate in a sub-threshold region. A load capacitance CL is given by equation (25) using gate capacitances Cmn1, Cmp3, and Cmp1 of the transistors MN1, MP3, and MP1.

$$CL = Cmn1 + Cmp3 + (AV+1)\cdot(Cmp1 + C1) \tag{25}$$

In equation (25), ΔV designates a voltage amplification factor of the transistor MP1 whose source is grounded, wherein the term (ΔV+1) designates a coefficient of a mirror effect. This description is given with respect to the time required for the transistor MP1 to be turned on; hence, ΔV=0.

Since a half of the differential voltage ΔVIN representing the differential input amplitude applied to a pair of the transistors MN1 and MN2 is applied to the transistor MN1 as its input amplitude, a time Tamp for reducing the potential of the gate A1_OUTB of the transistor MP1 by the threshold voltage VT(MP1) is given by equation (26).

$$Tamp = CL \cdot \frac{VT(MP1)}{gm \cdot \frac{\Delta VIN}{2}} \tag{26}$$

By use of prescribed values such as $I_0$=1 μA, S=100 mV/decade, CL=1 pF, VT(MP1)=−0.55 V, and ΔVIN=−10 mV, equation (26) produces the result of Tamp=9.55 μs.

By use of prescribed values such as α=0.5, VT(MN14)=0.55 V, VT(MP15)=−0.55 V, and VDD0=1.8 V, equation (23) produces the result of Th=0.3056·Tr; hence, Tr>31 μs when Th>Tamp. That is, the drive voltage (electronic power-supply voltage) VDD whose rise time in waveform is shorter than 31 μs may have a high risk of causing an operational failure in which the band-gap reference voltage source circuit of FIG. 9 fails to start operation.

As described above, the present inventor has recognized that substantially no current flows in the band-gap reference voltage source circuit of FIG. 5 in the rise time of the drive voltage (electronic power-supply voltage) VDD, thus causing a zero-current state in which the band-gap reference voltage source circuit cannot start operation. In order to avoid the occurrence of the zero-current state, the band-gap reference voltage source circuit of FIG. 9 introduces the detector block VDD_Detector to detect the rising of the drive voltage (electronic power-supply voltage) VDD so as to force a current to flow; however, there still remains a condition which does not prevent the zero-current state. This condition may cause negative influences to band-gap reference voltage source circuits in consideration of variations of manufacturing processes and variations of characteristics of transistors.

FIG. 11 shows simulation results of the band-gap reference voltage source circuit of FIG. 9, wherein the horizontal axis represents time while the vertical axis represents voltage.

Specifically, FIG. 11 shows three waveforms designated by numerals 1, 2, and 3, wherein the waveform 1 (drawn with dotted line and curve) indicates the drive voltage (electronic power-supply voltage) VDD, the waveform 2 (drawn with dashed line and curve) indicates the signal of the output terminal BG_REF which is simulated without consideration of variations of thresholds of transistors, and the waveform 3 (drawn with solid line and curve) indicates the signal of the output terminal BG_REF which is simulated with consideration of variations of thresholds of transistors. The level of the waveform 2 increases up to a prescribed voltage with respect to time, while the waveform 3 suffers from a short pullup time and does not substantially increase in level.

The band-gap reference voltage source circuit, in which the detector block detects the rising of the drive voltage (electronic power-supply voltage) VDD so as to achieve pullup to VDD, suffers from unstable variations of potentials and pullup times due to various parameters such as variations of the rise time of the drive voltage (electronic power-supply voltage), variations of processes, variations of transistors, and variations of temperature; hence, it is very difficult to secure a substantial potential for a sufficient time for starting the operation of the differential amplifier AMP1. For this reason, a starting circuit for securing a substantial potential for a sufficient time for starting the operation of the differential amplifier AMP1 is necessary for every LSI circuitry using the band-gap reference voltage source circuit to prevent a hangup failure occurring in electronic power-supply activation (power-on event).

SUMMARY

The invention seeks to solve the above problem or to improve upon the problem at least in part.

In one embodiment, there is provided a band-gap reference voltage source circuit that is constituted of a diode-pair circuit (BGR_Diode_Pair) including a first diode (D1) whose cathode is connected to a ground potential (VSS) and whose anode is connected to a first voltage detection terminal (IN1), a second diode (D2) whose junction area differs from a junction area of the first diode and whose cathode is connected to the ground potential, a first resistor (R1) which is connected between the first voltage detection terminal and a reference voltage output terminal (BG_REF), a second resistor (R2) which is connected between a second voltage detection terminal (IN2) and the reference voltage output terminal, and a third resistor (R3) which is connected between the second voltage detection terminal and an anode of the second diode; a first differential amplifier (AMP1) of an open-drain output type, which is constituted of a first first-conduction-type transistor (MP1) whose source is connected to a power-supply voltage (or a drive voltage) (VDD) and whose drain is connected to the reference voltage output terminal, and a first operational amplifier (A1) whose noninverting input terminal (+) is connected to the first voltage detection terminal, whose inverting input terminal (−) is connected to the second voltage detection terminal, and whose output terminal (A1_OUTB) is connected to a gate of the first first-conduction-type transistor; and a second differential amplifier (AMP2) of an open-drain output type, which is constituted of a second first-conduction-type transistor (MP2) whose source is connected to the power-supply voltage and whose drain is connected to the reference voltage output terminal, and a second operational amplifier (A2) whose noninverting input terminal (+) is connected to a first bias voltage (VR1) which is lower than a predetermined voltage (V_BG_REF) at the reference voltage output terminal, whose inverting input terminal (−) is connected to the reference voltage output terminal, and whose output terminal (A2_OUTB) is connected to a gate of the second first-conduction-type transistor.

In another embodiment, there is provided a band-gap reference voltage source circuit that generates and outputs a predetermined voltage to a reference voltage output terminal irrespective of a power-supply voltage. The band-gap reference voltage source circuit includes a bias generator which is connected to the power-supply voltage so as to generate a first bias voltage lower than the predetermined voltage, a diode-pair circuit in which a pair of resistors having different resistances is connected in series with a pair of diodes and is connected in parallel with the reference voltage output terminal, a first first-conduction-type transistor whose source is connected to the power-supply voltage and whose drain is connected to the reference voltage output terminal, a second first-conduction-type transistor whose source is connected to the power-supply voltage and whose drain is connected to the reference voltage output terminal, a first differential amplifier whose first and second input terminals are connected to nodes between the resistors and the diodes in the diode-pair circuit, and a second differential amplifier whose first input terminal is connected to the bias generator and whose second input terminal is connected to the reference voltage output terminal. Herein, the gate of the first first-conduction-type transistor is connected to the output terminal of the first differential amplifier; the gate of the second first-conduction-type transistor is connected to an output terminal of the second differential amplifier; the second differential amplifier operates based on the first bias voltage; the first differential amplifier operates when the second first-conduction-type transistor allows a current to flow through the diode-pair circuit, whereby the predetermined voltage is applied to the reference voltage output terminal when the second first-conduction-type transistor allows a current to flow through the diode-pair circuit.

BRIEF DESCRIPTION OF THE DRAWINGS

The above features and advantages of the present invention will be more apparent from the following description of certain preferred embodiments taken in conjunction with the accompanying drawings, in which.

DETAILED DESCRIPTION OF PREFERRED EMBODIMENTS

The present invention will be now described herein with reference to illustrative embodiments. Those skilled in the art will recognize that many alternative embodiments can be accomplished using the teachings of the present invention and that the invention is not limited to the embodiments illustrated for explanatory purposes.

1. First Embodiment

Figure 5:
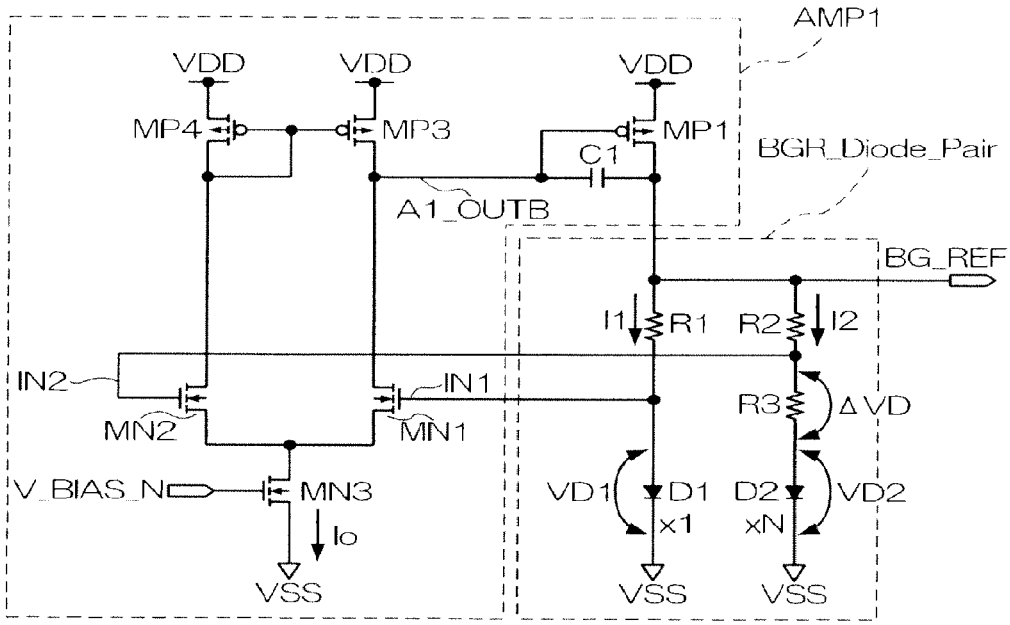
FIG. 5 is a circuit diagram showing an example of a band-gap reference voltage source circuit.
Figure 6:
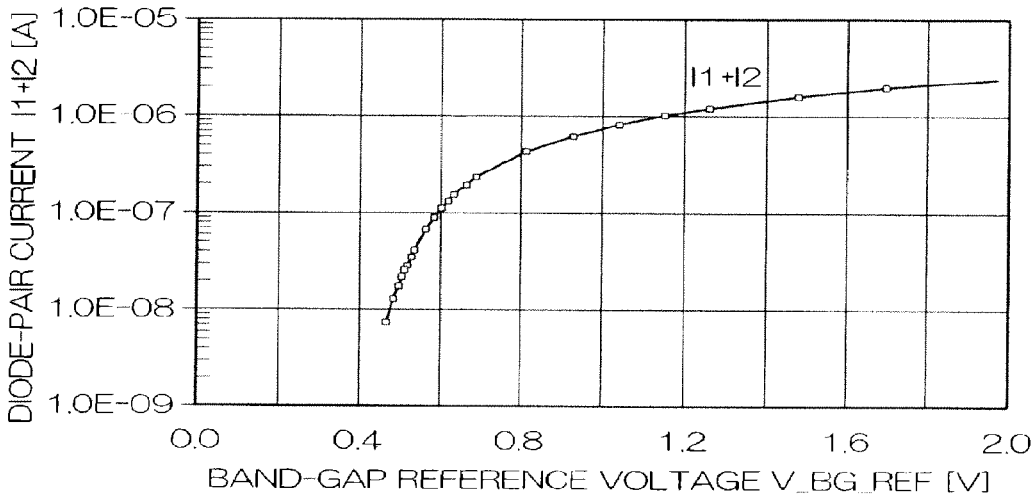
Prior Art FIG. 6
FIG. 6 is a graph showing the relationship between V_BG_REF and I1+I2 in the band-gap reference voltage source circuit of FIG. 5.
Figure 7:
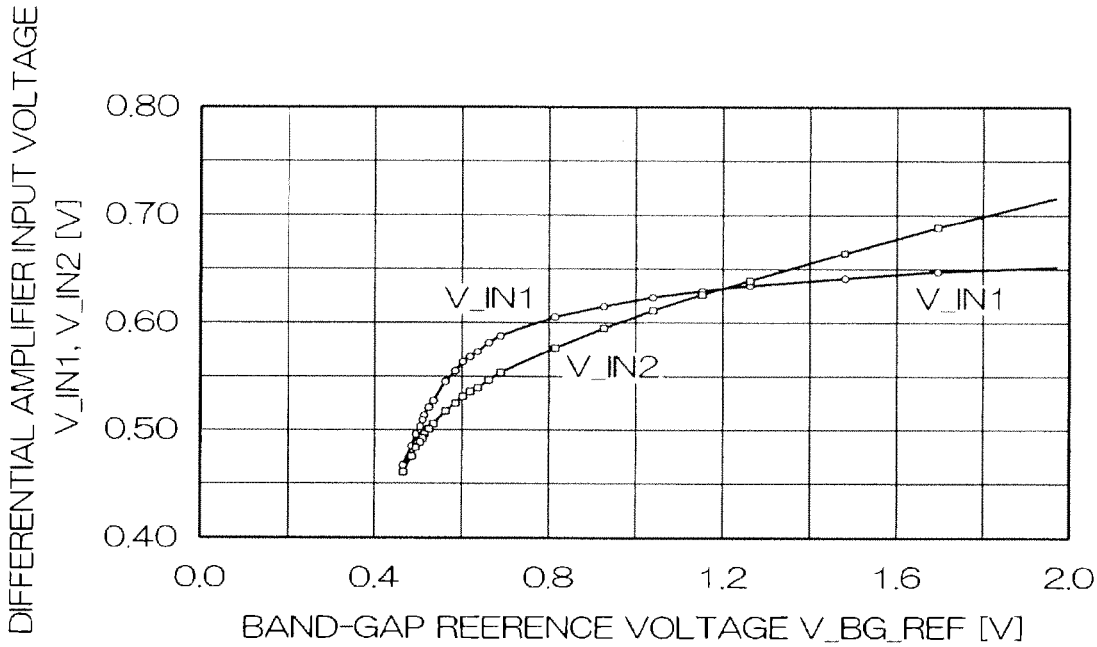
FIG. 7 is a graph showing the relationship between V_BG_REF, V_IN1, and V_IN2 in the band-gap reference voltage source circuit of FIG. 5.
Figure 8:
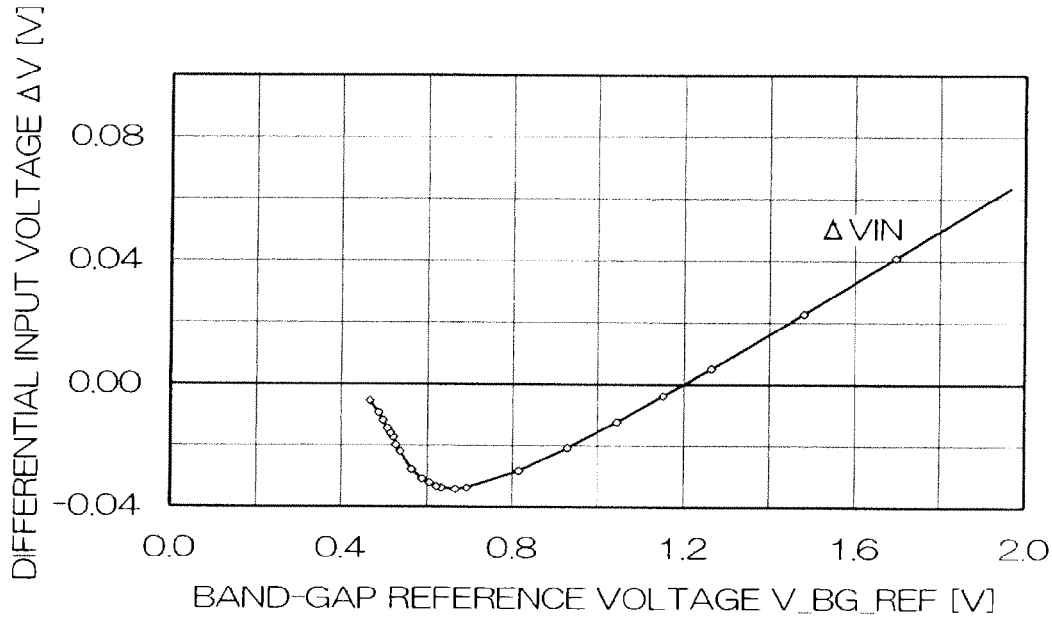
Prior Art FIG. 8
FIG. 8 is a graph showing the relationship between V_BG_REF and ΔVIN=V_IN2−V_IN1.
Figure 9:
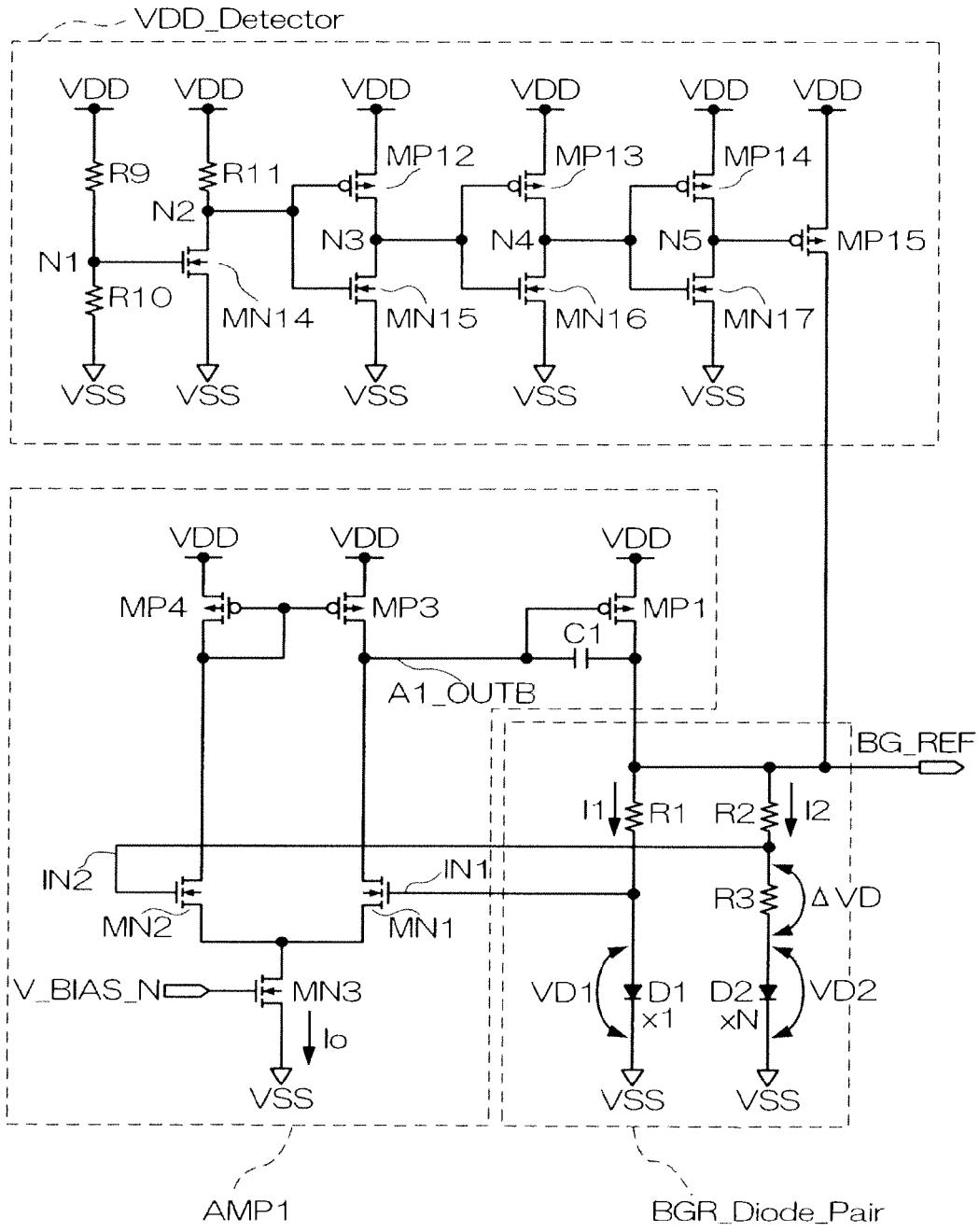
FIG. 9 is a circuit diagram showing another example of the band-gap reference voltage source circuit which includes a detector block in addition to the constitution of the band-gap reference voltage source circuit shown in FIG. 5.
Figure 10:
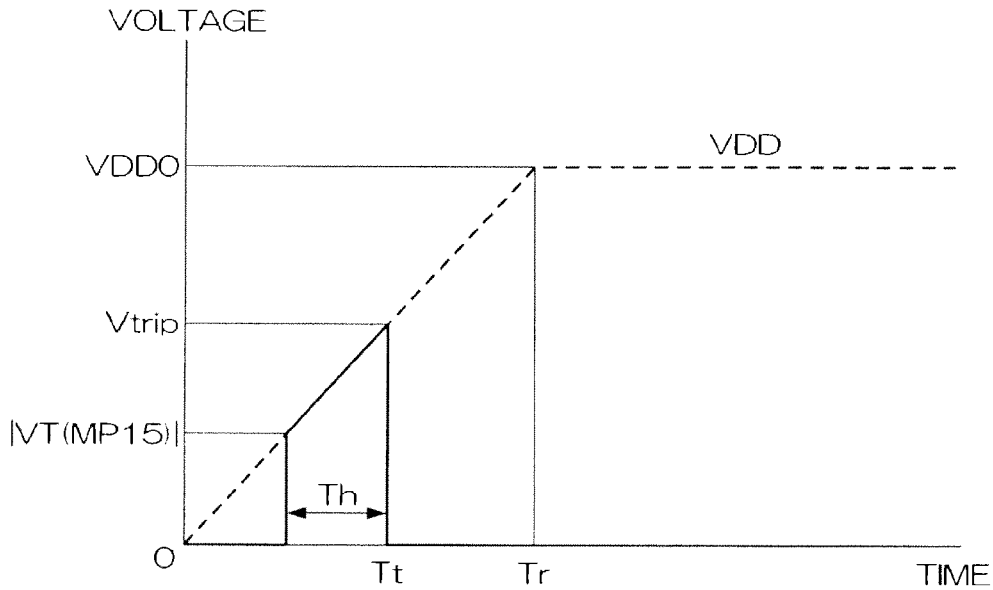
FIG. 10 is a graph showing the relationship between the drive voltage (electronic power-supply voltage) VDD and the output of the detector block in the band-gap reference voltage source circuit shown in FIG. 9.
Figure 11:
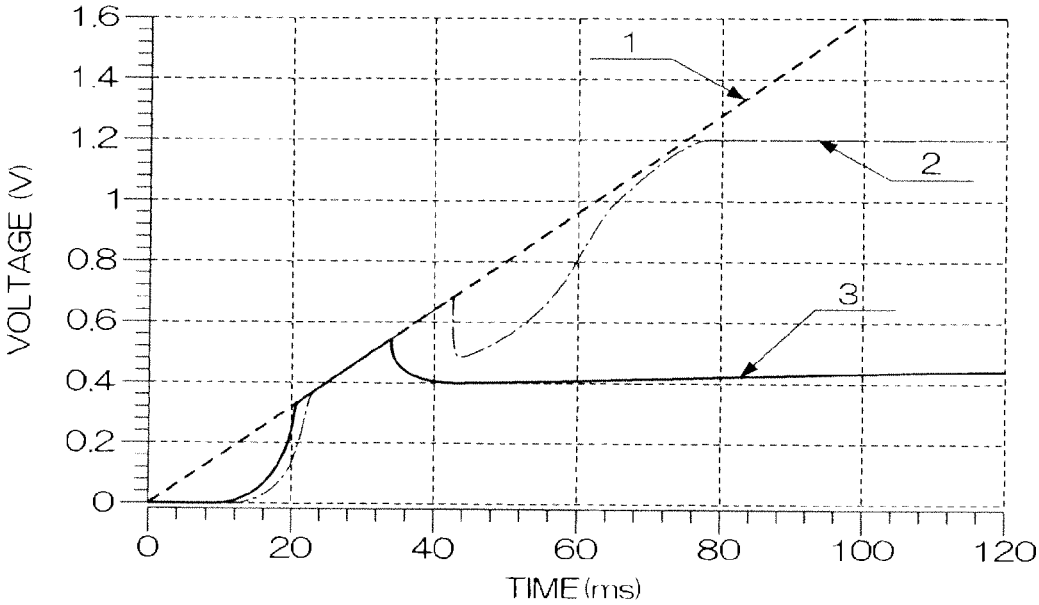
Prior Art FIG. 11
FIG. 11 is a graph showing waveforms representing the drive voltage (electronic power-supply voltage) VDD and the potential of a reference voltage output terminal BG_REF with and without consideration of variations of thresholds of transistors.

A band-gap reference voltage source circuit according to a first embodiment of the present invention will be described with reference to FIGS. 1 and 2, wherein parts identical to those shown in FIG. 5 are designated by the same reference numerals; hence, the duplicate descriptions thereof are simplified or omitted.

Figure 1:
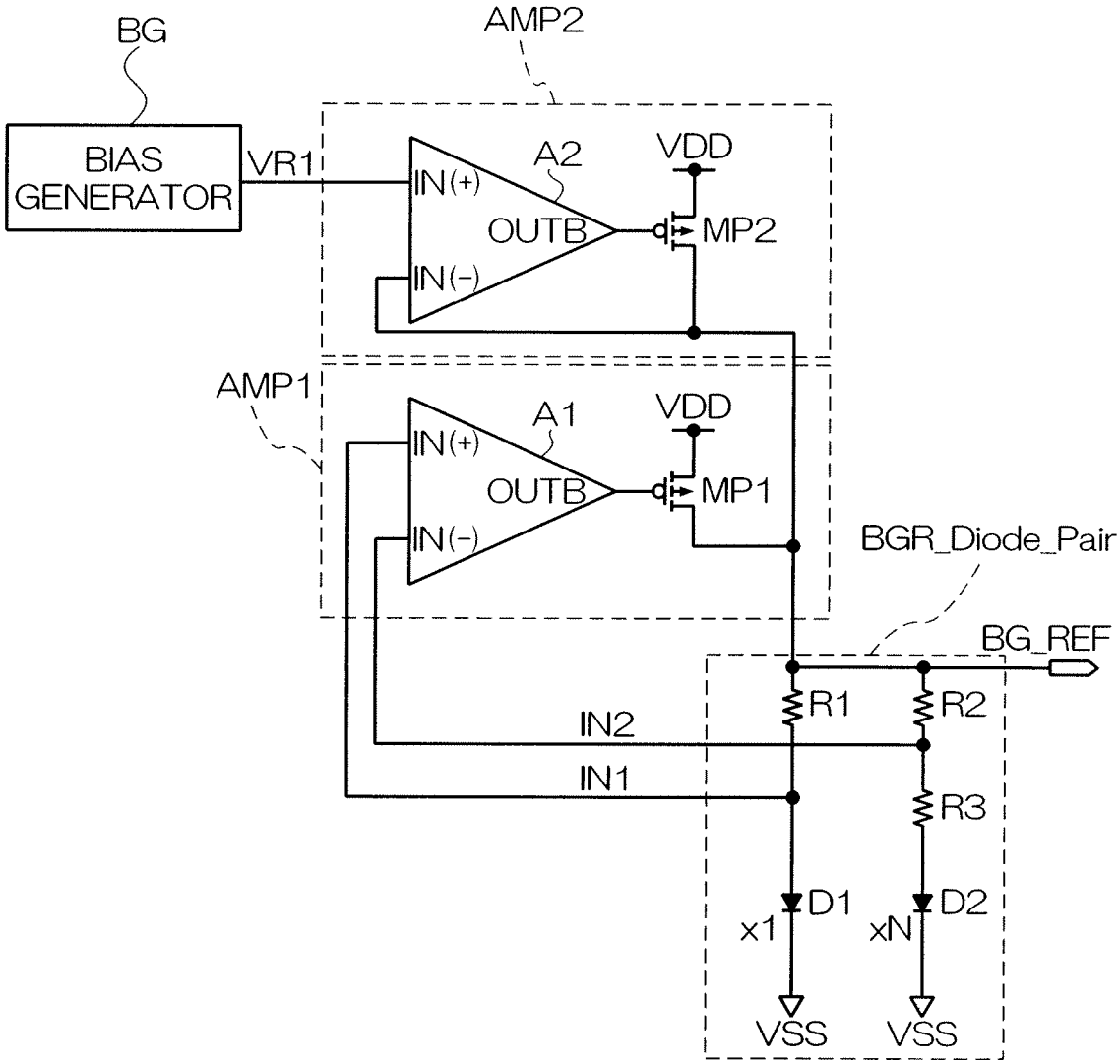
FIG. 1 is a block diagram showing the basic constitution of a band-gap reference voltage source circuit, which is constituted of a bias generator, first and second differential amplifiers, and a diode-pair circuit in accordance with a first embodiment of the present invention.
Figure 2:
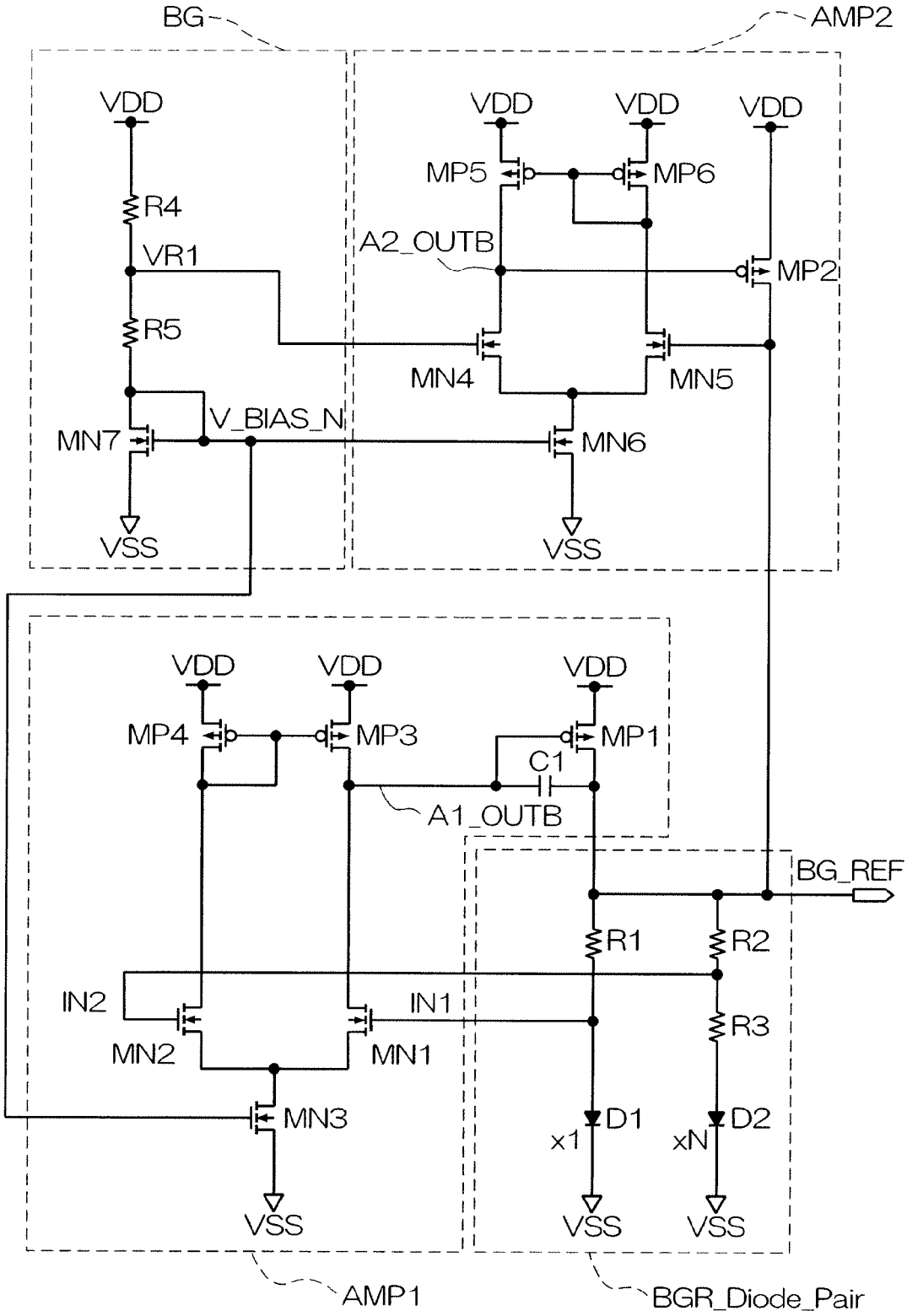
FIG. 2 is a circuit diagram showing the detailed constitution of the band-gap reference voltage source circuit according to the first embodiment of the present invention.

The band-gap reference voltage source circuit of the first embodiment shown in FIGS. 1 and 2 includes the diode-pair circuit BGR_Diode_Pair and the "first" differential amplifier AMP1 shown in FIG. 5. The first embodiment further includes a bias generator BG and a "second" differential amplifier AMP2, which is connected in parallel with the first differential amplifier AMP1 so as to serve as an auxiliary voltage source circuit capable of outputting a low voltage whose level is lower than the output voltage at the reference voltage output terminal BG_REF, thus stabilizing the starting operation of the band-gap reference voltage source circuit.

In FIG. 1, the first differential amplifier AMP1 includes a first operational amplifier A1 whose output terminal A1_OUTB is connected to the gate of the P-channel MOS transistor MP1, while the second differential amplifier AMP2 includes a second operational amplifier A2 whose output terminal A2_OUTB is connected to the gate of a P-channel MOS transistor MP2.

In the second differential amplifier AMP2, the noninverting input terminal IN(+) of the operational amplifier A2 receives a first bias voltage VR1 output from the bias generator BG, and the inverting input terminal IN(−) is connected to the reference voltage output terminal BG_REF.

The diode-pair circuit BGR_Diode_Pair shown in FIG. 1 is constituted of the diode D1 whose anode is connected to the node IN1 (serving as a first voltage detection terminal) and whose cathode is connected to the ground potential VSS, the diode D2 whose cathode is connected to the ground potential VSS and whose junction area differs from the junction area of the diode D1, the resistor R1 which is connected between the first voltage detection terminal IN1 and the reference voltage output terminal BG_REF, the resistor R2 which is connected between the node IN2 (serving as a second voltage detection terminal) and the reference voltage output terminal BG_REF, and the resistor R3 which is connected between the second voltage detection terminal IN2 and the anode of the diode D2.

In the first differential amplifier AMP1 which is configured of an open-drain output type, the source of the transistor MP1 is connected to the drive voltage (electronic power-supply voltage) VDD, the drain thereof is connected to the reference voltage output terminal BG_REF, and the gate thereof is connected to the output terminal A1_OUTB of the first operational amplifier A1, whose noninverting input terminal IN(+) is connected to the first voltage detection terminal IN1 and whose inverting input terminal IN(−) is connected to the second voltage detection terminal IN2.

In the second differential amplifier AMP2 which is configured of an open-drain output type, the source of the transistor MP2 is connected to the drive voltage (electronic power-supply voltage) VDD, the drain thereof is connected to the reference voltage output terminal BG_REF, and the gate thereof is connected to the output terminal A2_OUTB of the second operational amplifier A2, whose noninverting input terminal IN(+) receives the first bias voltage VR1 output from the bias generator BG and whose inverting input terminal IN(−) is connected to the reference voltage output terminal BG_REF.

The bias generator BG for generating the first bias voltage VR1 is configured of a current-mirror circuit. The bias generator BG is designed independently for use in the band-gap reference voltage source circuit. Alternatively, the bias generator BG can be designed commonly for use in other circuits.

FIG. 2 shows the detailed constitution of the band-gap reference voltage source circuit of FIG. 1. Specifically, the first operational amplifier A1 of the first differential amplifier AMP1 is constituted of the P-channel MOS transistor MP3 whose source is connected to the drive voltage (electronic power-supply voltage) VDD and whose drain is connected to the gate of the P-channel MOS transistor MP1, the P-channel MOS transistor MP4 whose source is connected to the drive voltage (electronic power-supply voltage) VDD and whose gate and drain are connected to the gate of the P-channel MOS transistor MP3, the N-channel MOS transistor MN1 whose gate is connected to the first voltage detection terminal IN1 and whose drain is connected to the drain of the P-channel MOS transistor MP3, the N-channel MOS transistor MN2 whose source is connected to the source of the N-channel MOS transistor MN1, whose gate is connected to the second voltage detection terminal IN2, and whose drain is connected to the drain of the P-channel MOS transistor MP4, and the N-channel MOS transistor MN3 whose source is connected to the ground potential VSS, whose gate is connected to a first gate bias V_BIAS_N generated by the bias generator BG, and whose drain is connected to the source of the N-channel MOS transistor MN1.

The second operational amplifier A2 of the second differential amplifier AMP2 is constituted of a P-channel MOS transistor MP5 whose source is connected to the drive voltage (electronic power-supply voltage) VDD and whose drain is connected to the gate of the P-channel MOS transistor MP2, a P-channel MOS transistor MP6 whose source is connected to the drive voltage (electronic power-supply voltage) VDD and whose gate and drain are connected to the gate of the P-channel MOS transistor MP5, an N-channel MOS transistor MN4 whose gate is connected to the first bias voltage VR1 and whose drain is connected to the drain of the P-channel MOS transistor MP5, an N-channel MOS transistor MN5 whose source is connected to the source of the N-channel MOS transistor MN4, whose gate is connected to the reference voltage output terminal BG_REF, and whose drain is connected to the drain of the P-channel MOS transistor MP6, and an N-channel MOS transistor MN6 whose source is connected to the ground potential VSS, whose gate is connected to the first gate bias V_BIAS_N, and whose drain is connected to the source of the N-channel MOS transistor MN4.

The bias generator BG is constituted of an N-channel MOS transistor MN7 whose source is connected to the ground potential VSS and whose gate and drain are connected to the first gate bias V_BIAS_N, a resistor R4 which is connected between the drive voltage (electronic power-supply voltage) VDD and the first bias voltage VR1, and a resistor R5 which is connected between the first bias voltage VR1 and the first gate bias V_BIAS_N.

In FIG. 2, the output terminal A1_OUTB of the first operational amplifier A1 corresponds to the drain of the P-channel MOS transistor MP3, while the output terminal A2_OUTB of the second operational amplifier A2 corresponds to the drain of the P-channel MOS transistor MP5. The phase compensation capacitor C1 is coupled between the gate and drain of the P-channel MOS transistor MP1 whose gate is connected to the output terminal A1_OUTB of the first operational amplifier A1.

Since the second differential amplifier AMP2 functions as a voltage-follower circuit, the potential of the reference voltage output terminal BG_REF becomes equal to the first bias voltage VR1 by way of the second differential amplifier AMP2 when the first differential amplifier AMP1 does not operate. This indicates that the reference voltage output terminal BG_REF is normally pulled up with the first bias voltage VR1. After a lapse of the start-up time required for the first differential amplifier AMP1 to start the operation in the pull-up condition, the first differential amplifier AMP1 starts to further pull up the reference voltage output terminal BG_REF with the predetermined voltage (e.g. approximately 1.2 V).

Since both the differential amplifiers AMP1 and AMP2 are configured of the open-drain output type using the transistors MP1 and MP2, the transistor MP2 is automatically turned off based on the first bias voltage VR1, which is lower than the predetermined voltage (e.g. approximately 1.2 V), when the output of the transistor MP1 is increased up to the predetermined voltage. That is, the potential of the reference voltage output terminal BG_REF is pulled up to the first bias voltage VR1 by the second differential amplifier AMP2; then, after a lapse of the start-up time required for the first differential amplifier AMP1 starts the operation, the reference voltage output terminal BG_REF is automatically switched over from the second differential amplifier AMP2 to the first differential amplifier AMP1.

Since the potential of the reference voltage output terminal BG_REF is held at the first bias voltage VR1 by the second differential amplifier AMP2 before the lapse of the start-up time of the first differential amplifier AMP1, the band-gap reference voltage source circuit of the first embodiment can starts the operation in a stable manner.

In FIG. 2, both the transistors MN3 and MN6 for flowing tail currents through the differential amplifiers AMP1 and AMP2 are supplied with the first gate bias V_BIAS_N output from the bias generator BG. It is possible to modify the band-gap reference voltage source circuit of the first embodiment in such a way that the first gate bias is generated by another circuit other than the bias generator BG.

The bias generator BG shown in FIG. 2 is formed by connecting the transistor MN7 whose gate and drain are coupled together and the resistors R4 and R5 in series, wherein the gate of the transistor MN7 serves as the first gate bias V_BIAS_N, and the first bias voltage VR1 is extracted from the connection point between the resistors R4 and R5. The first bias voltage VR1 is given by equation (27).

$$VR1 = VT(MN7) + [VDD - VT(MN7)] \cdot \frac{R5}{R4 + R5} \tag{27}$$

In the above, VR1=VDD when VDD<VT(MN7).

Figure 12:
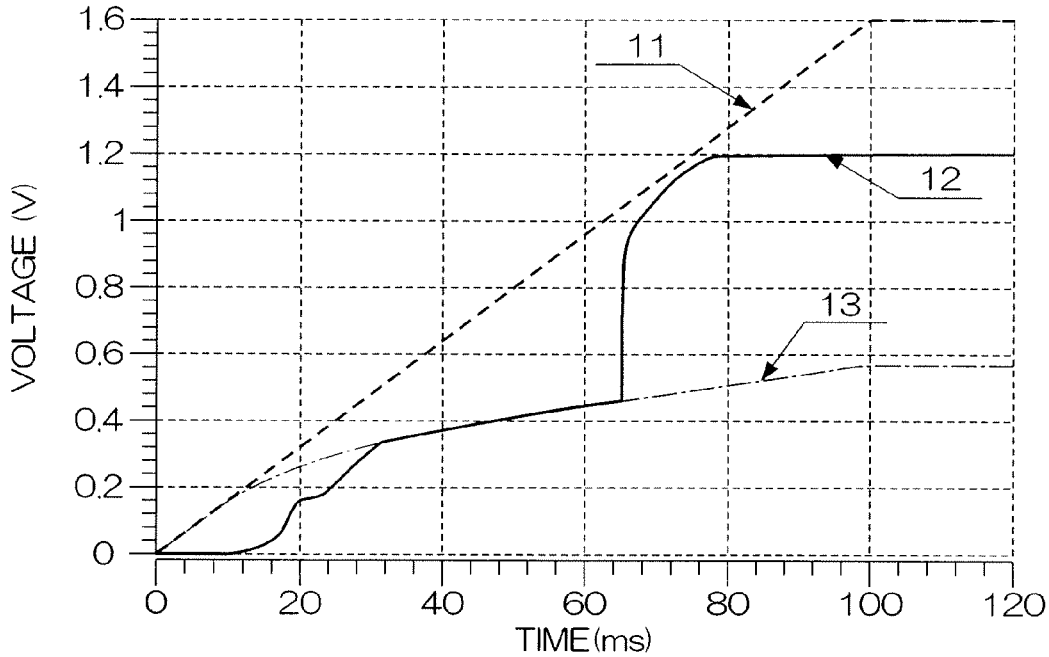
FIG. 12 is a graph showing waveforms representing the drive voltage (electronic power-supply voltage) VDD, the potential of the reference voltage output terminal BG_REF, and a first bias voltage VR1 output from the bias generator.

FIG. 12 shows waveforms 11 to 13 representing the simulation results of the band-gap reference voltage source circuit of FIG. 2, wherein the horizontal axis represents an elapsed time after electronic power-supply activation (power-on event), and the vertical axis represents voltage. Specifically, the waveform 11 (drawn with dotted line and curve) indicates the drive voltage (electronic power-supply voltage) VDD; the waveform 12 (drawn with solid line and curve) indicates the potential of the reference voltage output terminal BG_REF; and the waveform 13 (drawn with dashed line and curve) indicates the first bias voltage VR1. At the initial stage of the starting mode, the reference voltage output terminal BG_REF is pulled up to the first bias voltage VR1 by the second differential amplifier AMP2; and then after a lapse of the start-up time of the first differential amplifier AMP1 (e.g. approximately 65 ms), the reference voltage output terminal BG_REF is further pulled up in potential by the first differential amplifier AMP1.

2. Second Embodiment

Figure 3:
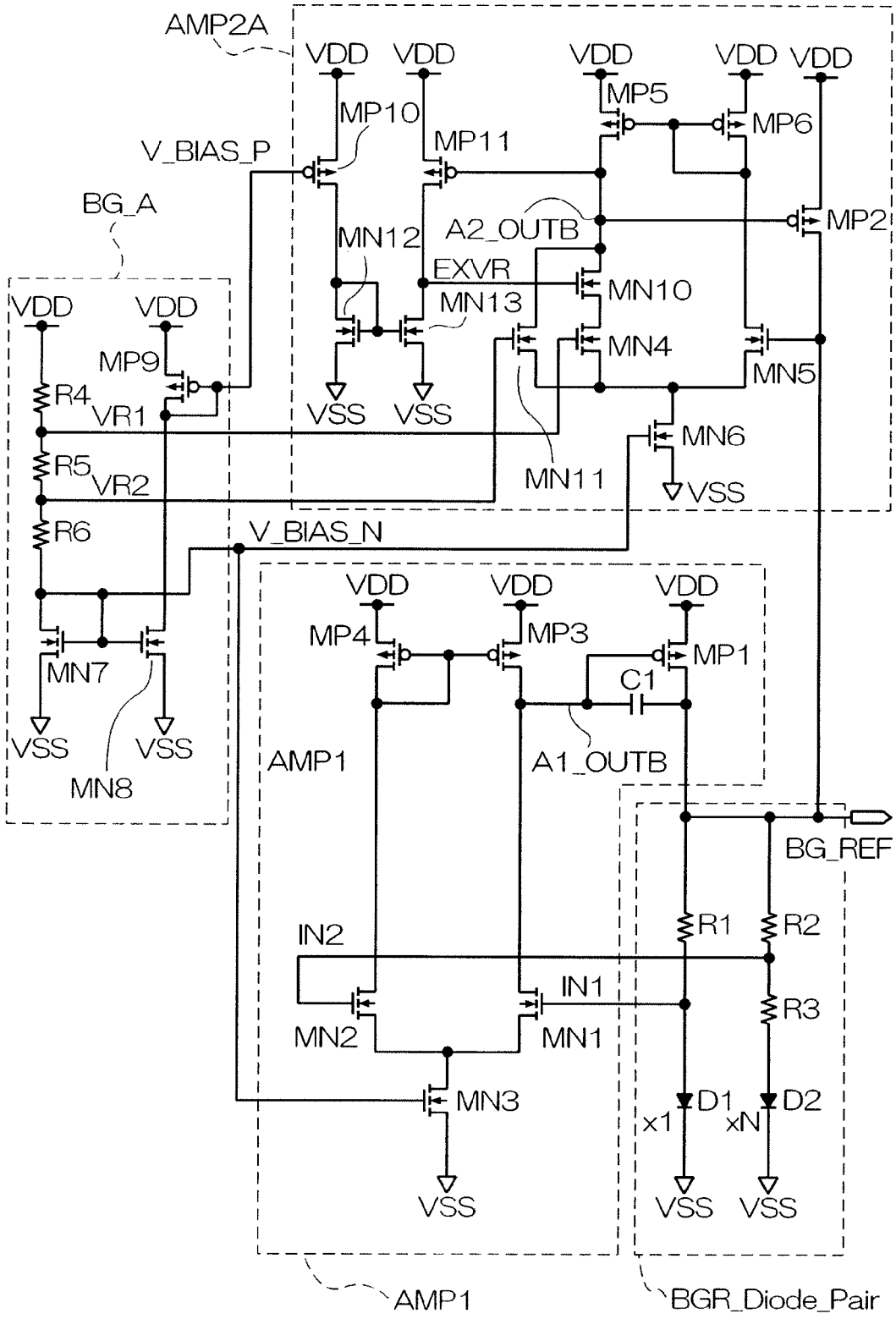
FIG. 3 is a circuit diagram showing the constitution of a band-gap reference voltage source circuit according to a second embodiment of the present invention.

FIG. 3 shows a band-gap reference voltage source circuit according to a second embodiment of the present invention, wherein parts identical to those shown in FIG. 2 are designated by the same reference numerals; hence, the duplicate descriptions thereof are simplified or omitted. The second embodiment shown in FIG. 3 differs from the first embodiment shown in FIG. 2 with respect to the bias generator BG and the second differential amplifier AMP2, which are replaced with a bias generator BG_A and a second differential amplifier AMP2A.

The second differential amplifier AMP2A shown in FIG. 3 is configured of an open-drain output type similar to the second differential amplifier AMP2 shown in FIG. 2 which is constituted of the P-channel MOS transistors MP2, MP5, and MP6 and the N-channel MOS transistors MN4, MN5, and MN6, wherein the second differential amplifier AMP2A further includes P-channel transistors MP10 and MP11 and N-channel MOS transistors MN10, MN11, MN12, and MN13. Specifically, the second differential amplifier AMP2A is constituted of the transistor MP2 whose source is connected to the drive voltage (electronic power-supply voltage) VDD and whose drain is connected to the reference voltage output terminal BG_REF, the transistor MP5 whose source is connected to the drive voltage (electronic power-supply voltage) VDD and whose drain is connected to the gate of the transistor MP2, the transistor MP6 whose source is connected to the drive voltage (electronic power-supply voltage) VDD and whose gate and drain are connected to the gate of the transistor MP5, the transistor MN10 whose gate is connected to a bias switch signal EXVR and whose drain is connected to the gate of the transistor MP2, the transistor MN4 whose gate is connected to the first bias signal VR1 and whose drain is connected to the source of the transistor MN10, the transistor MN5 whose source is connected to the source of the transistor MN4, whose gate is connected to the reference voltage output terminal BG_REF, and whose drain is connected to the drain of the transistor MP6, the transistor MN11 whose drain is connected to the gate of the transistor MP2, whose gate is connected to a second bias voltage VR2, and whose source is connected to the source of the transistor MN4, the transistor MN6 whose source is connected to the ground potential VSS, whose gate is connected to the first gate bias V_BIAS_N, and whose drain is connected to the source of the transistor MN4, the transistor MP11 whose source is connected to the drive voltage (electronic power-supply voltage) VDD, whose drain is connected to the bias switch signal EXVR, and whose gate is connected to the gate of the transistor MP2, the transistor MP10 whose source is connected to the drive voltage (electronic power-supply voltage) VDD and whose gate is connected to a second gate bias V_BIAS_P, the transistor MN12 whose source is connected to the ground potential VSS and whose gate and drain are connected to the drain of the transistor MP10, and the transistor MN13 whose source is connected to the ground potential VSS, whose gate is connected to the drain of the transistor MN12, and whose drain is connected to the bias switch signal EXVR.

The bias generator BG_A shown in FIG. 3 further includes a resistor R6, an N-channel MOS transistor MN8, and a P-channel MOS transistor MP9 in addition to the resistors R4 and R5 and the N-channel MOS transistor MN7 included in the bias generator BG shown in FIG. 2.

Specifically, the bias generator BG_A is constituted of the transistor MN7 whose source is connected to the ground potential VSS and whose gate and drain are connected to the first gate bias V_BIAS_N, the resistor R4 which is connected between the drive voltage (electronic power-supply voltage) VDD and the first bias voltage VR1, the resistor R5 which is connected between the first bias voltage VR1 and the second bias voltage VR2, the resistor R6 which is connected between the second bias voltage VR2 and the first gate bias V_BIAS_N, the transistor MN8 whose source is connected to the ground potential VSS, whose gate is connected to the first gate bias V_BIAS_N, and whose drain is connected to the second gate bias V_BIAS_P, and the transistor MP9 whose source is connected to the drive voltage (electronic power-supply voltage) VDD and whose gate and drain are connected to the second gate bias V_BIAS_P.

In FIG. 3, the gate of the transistor MN3 included in the first differential amplifier AMP1 is connected to the first gate bias V_BIAS_N. Similar to the constitution shown in FIG. 2, the output terminal A1_OUTB of the operational amplifier A1 included in the first differential amplifier AMP1 corresponds to the drain of the transistor MP3, while the output terminal A2_OUTB of the operational amplifier A2 included in the second differential amplifier AMP2A corresponds to the drain of the transistor MP5.

Next, the operation of the band-gap reference voltage source circuit of the second embodiment shown in FIG. 3 will be described in detail.

Similar to the first embodiment shown in FIG. 2, the second embodiment shown in FIG. 3 is designed such that the output terminal BG_REF is pulled up with the first bias voltage VR1 by the second differential amplifier AMP2A in the initial stage of electronic power-supply activation (power-on event) in which the first differential amplifier AMP1 does not start operation. At this time, a relatively low gate potential of the transistor MP2 appears at the output terminal A2_OUTB, so that the bias switch signal EXVR output from a level shift circuit constituted of the transistors MP10, MP11, MN12, and MN13 is set to the level of the drive voltage (electronic power-supply voltage) VDD.

When the first differential amplifier starts the operation so that the potential of the reference voltage output terminal BG_REF becomes higher than the first bias voltage VR1, the potential of the output terminal A2_OUTB increases up to VDD so as to turn off the transistor MP2. Herein, the bias switch signal EXVR is at VSS since the output terminal A2_OUTB is at VDD. The bias switch signal EXVR turns off the transistor MN10, so that the input bias voltage of the second differential amplifier AMP2A is switched over from VR1 to VR2. The bias voltages VR1 and VR2 generated by the bias generator BG_A are given by equations (28) and (29).

$$VR1 = VT(MN7) + [VDD - VT(MN7)] \cdot \frac{R5 + R6}{R4 + R5 + R6} \tag{28}$$

$$VR2 = VT(MN7) + [VDD - VT(MN7)] \cdot \frac{R6}{R4 + R5 + R6} \tag{29}$$

In the above, VR1=VR2=VDD when VDD<VT(MN7).

It is necessary to set the first bias voltage VR1 in an appropriate range, which is lower than the predetermined value (e.g. approximately 1.2 V) of the reference voltage output terminal BG_REF and is higher than the prescribed potential, reliably allowing the tail current to flow in the second differential amplifier AMP2A. This condition may be satisfied in the normal range of the drive voltage (electronic power-supply voltage) VDD; however, the first bias voltage VR1 defined by equation (28) likely becomes higher than the predetermined voltage (e.g. approximately 1.2 V) of the reference voltage output terminal BG_REF in a high power-supply voltage condition due to burn-in. This phenomenon will be explained in conjunction with FIG. 13, in which the horizontal axis represents VDD and the vertical axis represents VR1 and VR2.

Figure 13:
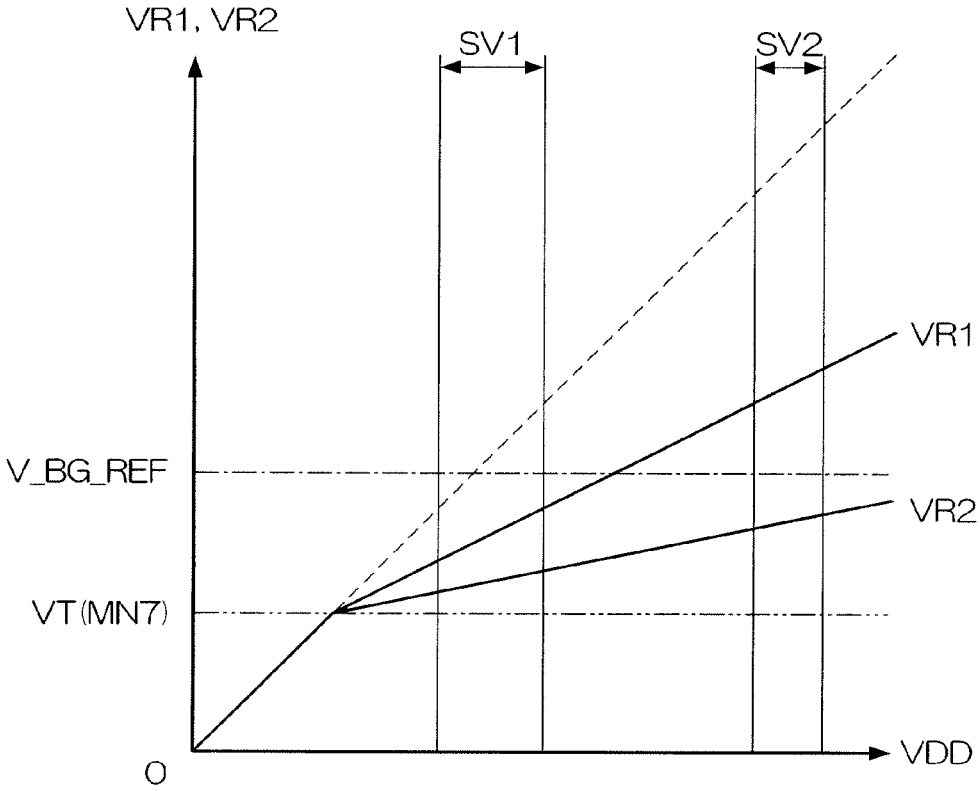
FIG. 13 is a graph showing drive voltage dependencies of bias voltages VR1 and VR2 dependent upon the drive voltage (electronic power-supply voltage) VDD in the band-gap reference voltage source circuit shown in FIG. 3.

FIG. 13 indicates the power-supply voltage dependency with regard to the bias voltages VR1 and VR2, wherein SV1 designates a normal range of the drive voltage (electronic power-supply voltage) VDD, and SV2 designates a burn-in range of the drive voltage (electronic power-supply voltage) VDD. In the burn-in range SV2, the first bias voltage VR1 becomes higher than the predetermined voltage V_BG_REF of the reference voltage output terminal BG_REF. In this case, the second differential amplifier AMP2A turns on the transistor MP2 again, while the first differential amplifier AMP1 turns off the transistor MP1. In order to prevent such an erroneous operation, the input bias voltage of the second differential amplifier AMP2A is switched over from VR1 to VR2 when the band-gap reference voltage source circuit switches over the operation from the second differential amplifier AMP2A to the first differential amplifier AMP1. Herein, the second bias voltage VR2 is determined such that the reference voltage of the reference voltage output terminal BG_REF does not exceed the predetermined voltage V_BG_REF, thus preventing the second differential amplifier AMP2A from turning on the transistor MP2 again.

Due to the switching between VR1 and VR2, it is possible to increase the first bias voltage VR1 to a high voltage. This is advantageous in that the second differential amplifier AMP2A can start the pullup operation at a low voltage.

3. Third Embodiment

Figure 4:
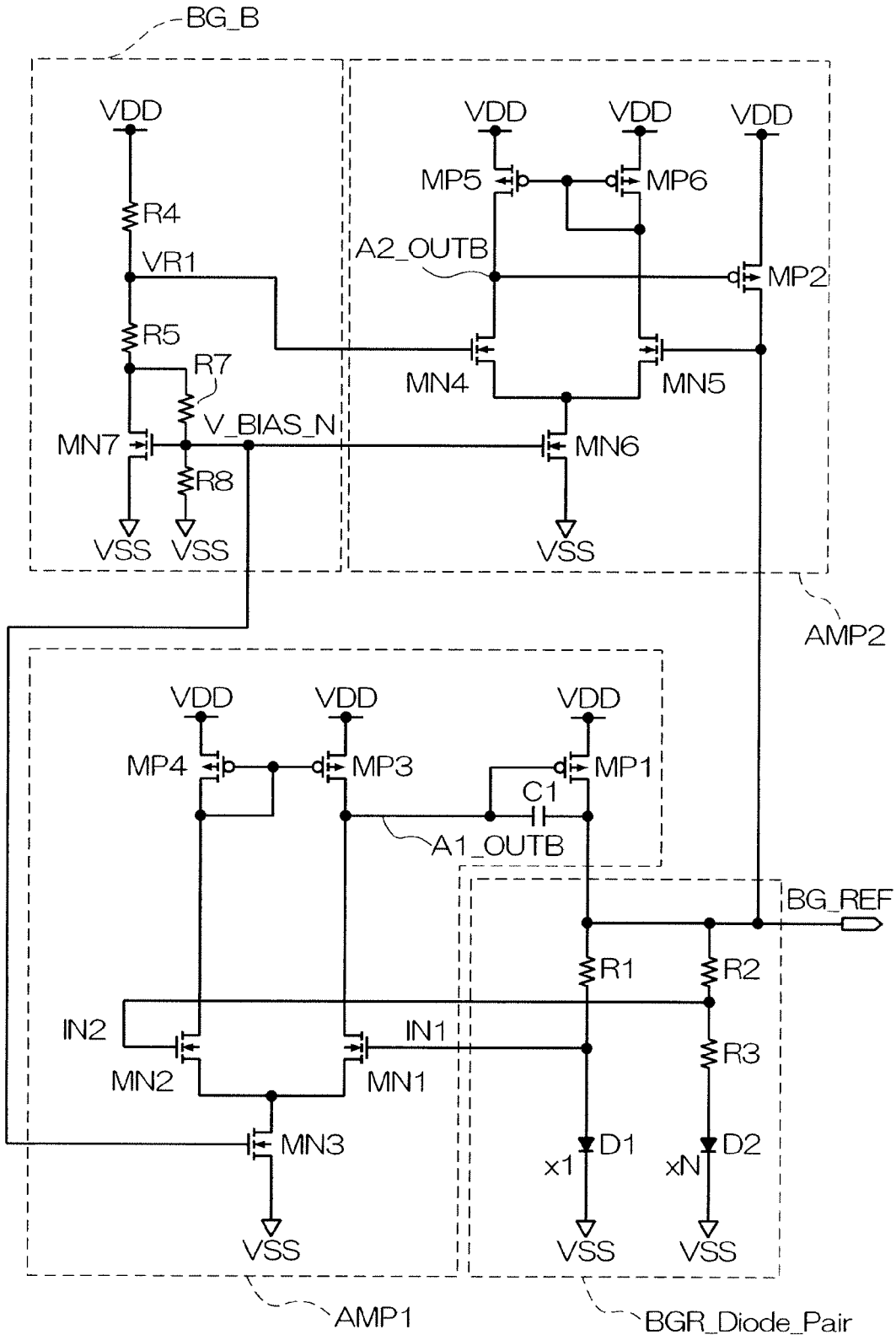
FIG. 4 is a circuit diagram showing the constitution of a band-gap reference voltage source circuit according to a third embodiment of the present invention.

FIG. 4 shows a band-gap reference voltage source circuit according to a third embodiment of the present invention, wherein parts identical to those shown in FIG. 2 are designated by the same reference numerals; hence, the duplicate descriptions thereof will be simplified or omitted.

The constitution of the third embodiment shown in FIG. 4 is basically identical to the constitution of the first embodiment shown in FIG. 2 except that the bias generator BG is replaced with a bias generator BG_B.

The bias generator BG_B shown in FIG. 4 further includes resistors R7 and R8 in addition to the resistors R4 and R5 and the N-channel MOS transistor MN7 included in the bias generator BG shown in FIG. 2. Specifically, the bias generator BG_B is constituted of the transistor MN7 whose source is connected to the ground potential VSS and whose gate is connected to the first gate bias V_BIAS_N, the resistor R4 which is connected between the drive voltage (electronic power-supply voltage) VDD and the first bias voltage VR1, the resistor R5 which is connected between the first bias voltage VR1 and the drain of the transistor MN7, the resistor R7 which is connected between the first gate bias V_BIAS_N and the drain of the transistor MN7, and the resistor R8 which is connected between the first gate bias V_BIAS_N and the ground potential VSS.

Next, the operation of the band-gap reference voltage source circuit of the third embodiment shown in FIG. 4 will be described in detail. The operation of the third embodiment is basically identical to the operation of the first embodiment except that the bias generator BG_B generates the first bias voltage VR1 whose level differs from the level of the foregoing first bias voltage VR1 generated by the bias generator BG. The third embodiment is characterized in that the resistances of the resistors R7 and R8 are adequately increased so as to apply the current flowing through the resistor R5 substantially to the transistor MN7. The first bias voltage VR1 generated by the bias generator BG_B is given by equation (30).

$$VR1 = \text{V_pedestal} + [VDD - \text{V_pedestal}] \cdot \frac{R5}{R4 + R5} \tag{30}$$

In the above, VR1=VDD when VDD<V_pedestal, wherein V_pedestal designates a pedestal voltage which is given by equation (31).

$$\text{V_pedestal} = VT(MN7) \cdot \left(1 + \frac{R7}{R8}\right) \tag{31}$$

Figure 14:
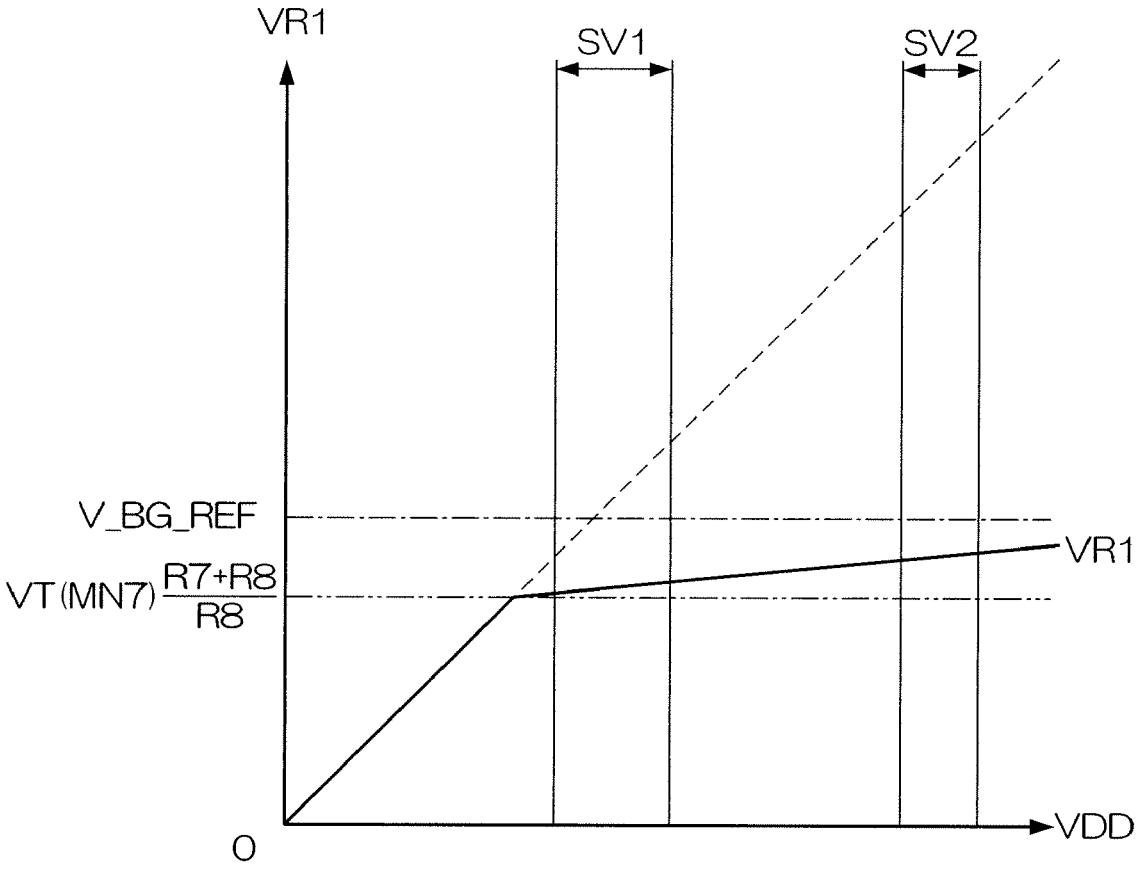
FIG. 14 is a graph showing the drive voltage dependency of the bias voltages VR1 dependent upon the drive voltage (electronic power-supply voltage) VDD in the band-gap reference voltage source circuit shown in FIG. 4.

FIG. 14 shows the relationship between the first bias voltage VR1 and the drive voltage (electronic power-supply voltage) VDD. Compared with FIG. 13, FIG. 14 shows that the first bias voltage VR1 increases in correspondence with the drive voltage (electronic power-supply voltage) VDD up to the pedestal voltage V_pedestal, thereafter, it further increases by the factor R5/(R4+R5). Since the pedestal voltage V_pedestal is higher than the threshold voltage VT(MN7) of the transistor MN7, it is possible to reduce the factor R5/(R4+R5), thus preventing the first bias voltage VR1 from exceeding the predetermined voltage V_BG_REF of the reference voltage output terminal BG_REF in the burn-in range SV2. This eliminates the necessity of switching between VR1 and VR2.

The above embodiments are each designed such that the second differential amplifier AMP2 (or AMP2A) which is configured of an open-drain output type serving as a voltage-follower circuit is connected to the reference voltage output terminal BG_REF of the band-gap reference voltage source circuit constituted of the diode-pair circuit BRG_Diode_Pair (including the diodes D1 and D2) and the first differential amplifier AMP1 configured of an open-drain output type, wherein the first bias voltage VR1 for the second differential amplifier AMP2 is lower than the predetermined voltage V_BG_REF (e.g. approximately 1.2 V) which is set to the reference voltage output terminal BG_REF. In the initial stage of electronic power-supply activation (power-on event), the reference voltage output terminal BG_REF is pulled up with the first bias voltage VR1 by the second differential amplifier AMP2; then, after a lapse of the start-up time of the first differential amplifier AMP1, the reference voltage output terminal BG_REF is automatically switched from the second differential amplifier AMP2 to the first differential amplifier AMP1. This guarantees that the reference voltage output terminal BG_REF is pulled up with the first bias voltage VR1 by the second differential amplifier AMP2 until the first differential amplifier AMP1 starts operation; hence, it is possible to reliably start the operation of the band-gap reference voltage source circuit without problem.

The band-gap reference voltage source circuit of the present invention can be modified in various ways using various circuit elements such as transistors, resistors, and capacitors, which can be appropriately connected together in parallel and in series. Moreover, transistors are not necessarily limited to MOS transistors, which can be replaced with MIS transistors, for example.

It is apparent that the present invention is not limited to the above embodiments, but may be modified and changed without departing from the scope and spirit of the invention.

What is claimed is:

1. A band-gap reference voltage source circuit comprising:

a diode-pair circuit including a first diode whose cathode is connected to a ground potential and whose anode is connected to a first voltage detection terminal, a second diode whose junction area differs from a junction area of the first diode and whose cathode is connected to the ground potential, a first resistor which is connected between the first voltage detection terminal and a reference voltage output terminal, a second resistor which is connected between a second voltage detection terminal and the reference voltage output terminal, and a third resistor which is connected between the second voltage detection terminal and an anode of the second diode;

a first differential amplifier of an open-drain output type, which is constituted of a first first-conduction-type transistor whose source is connected to a power-supply voltage and whose drain is connected to the reference voltage output terminal, and a first operational amplifier whose noninverting input terminal is connected to the first voltage detection terminal, whose inverting input terminal is connected to the second voltage detection terminal, and whose output terminal is connected to a gate of the first first-conduction-type transistor; and a second differential amplifier of an open-drain output type, which is constituted of a second first-conduction-type transistor whose source is connected to the power-supply voltage and whose drain is connected to the reference voltage output terminal, and a second operational amplifier whose noninverting input terminal is disconnected from each of the first and second voltage detection terminals and is connected to a first bias voltage which is lower than a predetermined voltage at the reference voltage output terminal, whose inverting input terminal is connected to the reference voltage output terminal, and whose output terminal is connected to a gate of the second first-conduction-type transistor.

2. The band-gap reference voltage source circuit according to claim 1, wherein the first operational amplifier is constituted of a third first-conduction-type transistor whose source is connected to the power-supply voltage and whose drain is connected to the gate of the first first-conduction-type transistor, a fourth first-conduction-type transistor whose source is connected to the power-supply voltage and whose gate and drain are connected to a gate of the third first-conduction-type transistor, a first second-conduction-type transistor whose gate is connected to the first voltage detection terminal and whose drain is connected to the drain of the third first-conduction-type transistor, a second second-conduction-type transistor whose source is connected to the source of the first second-conduction-type transistor, whose gate is connected to the second voltage detection terminal, and whose drain is connected to the drain of the fourth first-conduction-type transistor, and a third second-conduction-type transistor whose source is connected to the ground potential, whose gate is connected to a first gate bias, and whose drain is connected to the source of the first second-conduction-type transistor, wherein the second operational amplifier is constituted of a fifth first-conduction-type transistor whose source is connected to the power-supply voltage and whose drain is connected to the gate of the second first-conduction-type transistor, a sixth first-conduction-type transistor whose source is connected to the power-supply voltage and whose gate and drain are connected to a gate of the fifth first-conduction-type transistor, a fourth second-conduction-type transistor whose gate is connected to the first bias voltage and whose drain is connected to the drain of the fifth first-conduction-type transistor, a fifth second first-conduction-type transistor whose source is connected to a source of the fourth second-conduction-type transistor, whose gate is connected to the reference voltage output terminal and whose drain is connected to the drain of the sixth first-conduction-type transistor, and a sixth second-conduction-type transistor whose source is connected to the ground potential, whose gate is connected to the first gate bias, and whose drain is connected to a source of the fourth second-conduction-type transistor, and wherein the first bias voltage and the first gate bias are generated by a seventh second-conduction-type transistor whose source is connected to the ground potential and whose gate is connected to the first gate bias by way of a diode connection, a fourth resistor which is connected between the power-supply voltage and the first bias voltage, and a fifth resistor which is connected between the first bias voltage and the first gate bias.

3. The band-gap reference voltage source circuit according to claim 2 wherein the bias generator further includes a seventh resistor which is connected between the first gate bias and the drain of the seventh second-conduction-type transistor, and an eighth resistor which is connected between the first gate bias and the ground potential.

4. The band-gap reference voltage source circuit according to claim 1, wherein the second differential amplifier is constituted of a fifth first-conduction-type transistor whose source is connected to the power-supply voltage and whose drain is connected to the gate of the second first-conduction-type transistor, a sixth first-conduction-type transistor whose source is connected to the power-supply voltage and whose drain and gate are connected to the a gate of the fifth first-conduction-type transistor, a tenth second-conduction-type transistor whose gate is connected to a bias switch signal and whose drain is connected to the gate of the second first-conduction-type transistor, a fourth second-conduction-type transistor whose gate is connected to the first bias voltage and whose drain is connected to a source of the tenth second-conduction-type transistor, a fifth second-conduction-type transistor whose source is connected to a source of the fourth second-conduction-type transistor, whose gate is connected to the reference voltage output terminal, and whose drain is connected to the drain of the sixth first-conduction-type transistor, an eleventh second-conduction-type transistor whose drain is connected to the gate of the second first-conduction-type transistor, whose gate is connected to a second bias voltage, and whose source is connected to the source of the fourth second-conduction-type transistor, a sixth second-conduction-type transistor whose source is connected to the ground potential, whose gate is connected to a first gate bias, and whose drain is connected to the source of the fourth second-conduction-type transistor, an eleventh first-conduction-type transistor whose source is connected to the power-supply voltage, whose drain is connected to the bias switch signal, and whose gate is connected to the gate of the second first-conduction-type transistor, a tenth first-conduction-type transistor whose source is connected to the power-supply voltage and whose gate is connected to a second gate bias, a twelfth second-conduction-type transistor whose source is connected to the ground potential and whose gate and drain are connected to the drain of the tenth first-conduction-type transistor, and a thirteenth second-conduction-type transistor whose source is connected to the ground potential, whose gate is connected to the drain of the twelfth second-conduction-type transistor, and whose drain is connected to the bias switch signal, and wherein the first bias voltage, the second bias voltage, the first gate bias, and the second gate bias are generated by a bias generator including a seventh second-conduction-type transistor whose source is connected to the ground potential and whose gate and drain are connected to the first gate bias, a fourth resistor which is connected between the power-supply voltage and the first bias voltage, a fifth resistor which is connected between the first bias voltage and the second bias voltage, a sixth resistor which is connected between the second bias voltage and the first gate bias, an eighth second-conduction-type transistor whose source is connected to the ground potential and whose gate is connected to the first gate bias, and whose drain is connected to the second gate bias, and a ninth first-conduction-type transistor whose source is connected to the power-supply voltage and whose gate and drain are connected to the second gate bias.

5. The band-gap reference voltage source circuit according to claim 1, wherein the first bias voltage corresponds to a division of the power-supply voltage which is divided by way of a plurality of resistors connected in series.

6. The band-gap reference voltage source circuit according to claim 1 further comprising a switching circuit for switching over a plurality of levels, one of which is selectively supplied to the noninverting input terminal of the second operational amplifier in response to a level of the reference voltage output terminal.

7. A band-gap reference voltage source circuit which generates and outputs a predetermined voltage to a reference voltage output terminal irrespective of a power-supply voltage, comprising:

a bias generator which is connected to the power-supply voltage so as to generate a first bias voltage lower than the predetermined voltage;

a diode-pair circuit in which a pair of resistors having different resistances is connected in series with a pair of diodes and is connected in parallel with the reference voltage output terminal;

a first first-conduction-type transistor whose source is connected to the power-supply voltage and whose drain is connected to the reference voltage output terminal;

a second first-conduction-type transistor whose source is connected to the power-supply voltage and whose drain is connected to the reference voltage output terminal;

a first differential amplifier whose first and second input terminals are connected to nodes between the resistors and the diodes in the diode-pair circuit; and a second differential amplifier whose first input terminal is disconnected from each of the nodes and is connected to the bias generator and whose second input terminal is connected to the reference voltage output terminal;

wherein a gate of the first first-conduction-type transistor is connected to an output terminal of the first differential amplifier, a gate of the second first-conduction-type transistor is connected to an output terminal of the second differential amplifier, the second differential amplifier operates based on the first bias voltage, the first differential amplifier operates when the second first-conduction-type transistor allows a current to flow through the diode-pair circuit, so that the predetermined voltage is applied to the reference voltage output terminal when the second first-conduction-type transistor allows the current to flow through the diode-pair circuit.

8. The band-gap reference voltage source circuit according to claim 7, wherein the bias generator is constituted of two resistors, a node between which outputs the first bias voltage, and a diode connected in series with the two resistors.

9. The band-gap reference voltage source circuit according to claim 7, wherein the bias generator generates a second bias voltage lower than the first bias voltage, said band-gap reference voltage source circuit further comprising a switching means which, after activation of the first differential amplifier, switches the first bias voltage to the second bias voltage to be supplied to the first input terminal of the second differential amplifier.

10. The band-gap reference voltage source circuit according to claim 9, wherein the second bias voltage is lower than the predetermined voltage.

11. The band-gap reference voltage source circuit according to claim 10, wherein the second first-conduction-type transistor remains at rest when the first bias voltage is switched to the second bias voltage.

12. The band-gap reference voltage source circuit according to claim 9, wherein the switching means compares a first voltage whose value is proportional to the power-supply voltage to a second voltage whose value is proportional to the output voltage at the reference voltage output terminal.

13. The band-gap reference voltage source circuit according to claim 7, wherein the first bias voltage is produced by varying the power-supply voltage with a first incline coefficient in a first region and with a second incline coefficient in a second region.

14. The band-gap reference voltage source circuit according to claim 13, wherein the first bias voltage in the second region is lower than the predetermined voltage.

15. The band-gap reference voltage source circuit according to claim 14, wherein the second first-conduction-type transistor remains at rest when the first differential amplifier operates in the first region.

16. A device comprising:

a band-gap regulator generating at an output terminal thereof a band-gap voltage, the band-gap regulator comprising a first differential amplifier that includes first and second input nodes and a first output node;

a bias voltage generator generating a bias voltage that is different from the band-gap voltage; and a second differential amplifier including third and fourth input nodes and a second output node, the third input node being separated from each of the first and second input nodes of the first differential amplifier and being connected to the bias voltage generator to receive the bias voltage, and the fourth input node and the second output node being electrically connected in common to the output terminal of the band-gap regulator.

17. The device as claimed in claim 16, wherein the band-gap regulator further comprises first and second circuits that are provided in parallel to each other between the output terminal and a reference potential line, the first circuit including a first PN junction and a first resistor connected in series, the second circuit including a second PN junction and second and third resistors connected in series, the first input node of the first differential amplifier being supplied with a first voltage that is related to a voltage across the first PN junction, the second input node of the first differential amplifier being supplied with a second voltage that is related to a voltage across the second PN junction, and the output node of the first differential amplifier being electrically connected to the output terminal.

18. The device as claimed in claim 16, wherein the bias voltage generator further generates an additional bias voltage that is different from each of the first bias voltage and the band-gap voltage, and the second differential amplifier further includes a third input node that is separated from each of the first and second input nodes of the first differential amplifier and is connected to receive the additional bias voltage.

19. The device as claimed in claim 18, wherein the bias voltage is lower than the band-gap voltage, and the additional bias voltage is between the bias voltage and the band-gap voltage.

20. The device as claimed in claim 16, wherein the bias voltage is lower than the band-gap voltage.

* * * * *